US008713855B2

(12) United States Patent
Brewerton

(10) Patent No.: US 8,713,855 B2
(45) Date of Patent: May 6, 2014

(54) OVERPRESSURE RELIEF ROOF PANELS

(75) Inventor: Robert Walter Brewerton, Kent (GB)

(73) Assignee: Inoventech Limited, London (GB)

( * ) Notice: Subject to any disclaimer, the term of this patent is extended or adjusted under 35 U.S.C. 154(b) by 0 days.

(21) Appl. No.: 13/697,431

(22) PCT Filed: May 13, 2011

(86) PCT No.: PCT/EP2011/057807

§ 371 (c)(1),
(2), (4) Date: Jun. 4, 2013

(87) PCT Pub. No.: WO2011/141576

PCT Pub. Date: Nov. 17, 2011

(65) Prior Publication Data

US 2013/0269264 A1 Oct. 17, 2013

(30) Foreign Application Priority Data

May 14, 2010 (GB) ..... 1008071.1

(51) Int. Cl.
*E04H 14/00* (2006.01)
*E04H 9/00* (2006.01)

(52) U.S. Cl.
USPC ..... 52/1

(58) Field of Classification Search
USPC ..... 52/1, 64–66, 69
See application file for complete search history.

(56) References Cited

U.S. PATENT DOCUMENTS

| | | | | |
|---|---|---|---|---|
| 3,807,106 | A * | 4/1974 | Reinhardt et al. | 52/98 |
| 4,014,148 | A * | 3/1977 | Harter | 52/403.1 |
| 2007/0044411 | A1* | 3/2007 | Meredith et al. | 52/586.1 |

FOREIGN PATENT DOCUMENTS

| | | |
|---|---|---|
| EP | 2 105 549 A1 | 9/2009 |
| GB | 2278376 | 11/1994 |
| GB | 2315288 | 1/1998 |
| WO | WO 89/11007 | 11/1989 |
| WO | WO 2011/084071 | 7/2011 |

OTHER PUBLICATIONS

International Search Report prepared by the European Patent Office on Aug. 8, 2011, for International Application No. PCT/EP2011/057807.

* cited by examiner

*Primary Examiner* — Mark Wendell

(74) *Attorney, Agent, or Firm* — Sheridan Ross P.C.

(57) ABSTRACT

An explosion relief panel (34) suitable for use as a roof panel and comprising, when oriented as a roof panel, a raised longitudinally extending edge portion (52) which is raised above a respective adjacent longitudinally extending drain portion (53) of the panel and which has a second raised longitudinally extending portion (54) which is raised above a respective adjacent longitudinally extending drain portion (55) lying between said second raised portion (54) and said edge portion (52), the said second raised portion being fixed to a first support member (38) and the said edge portion being mounted to a second support member (40 or 42) in a manner such as to be released therefrom in response to an overpressure applied beneath the roof panel to allow the edge of the roof panel to be deflected upwardly to release said overpressure whilst the second portion of the roof panel remains fixed to said first support member. The panel may form part of a roof panel cassette or may be directly assembled to a roof framework.

19 Claims, 9 Drawing Sheets

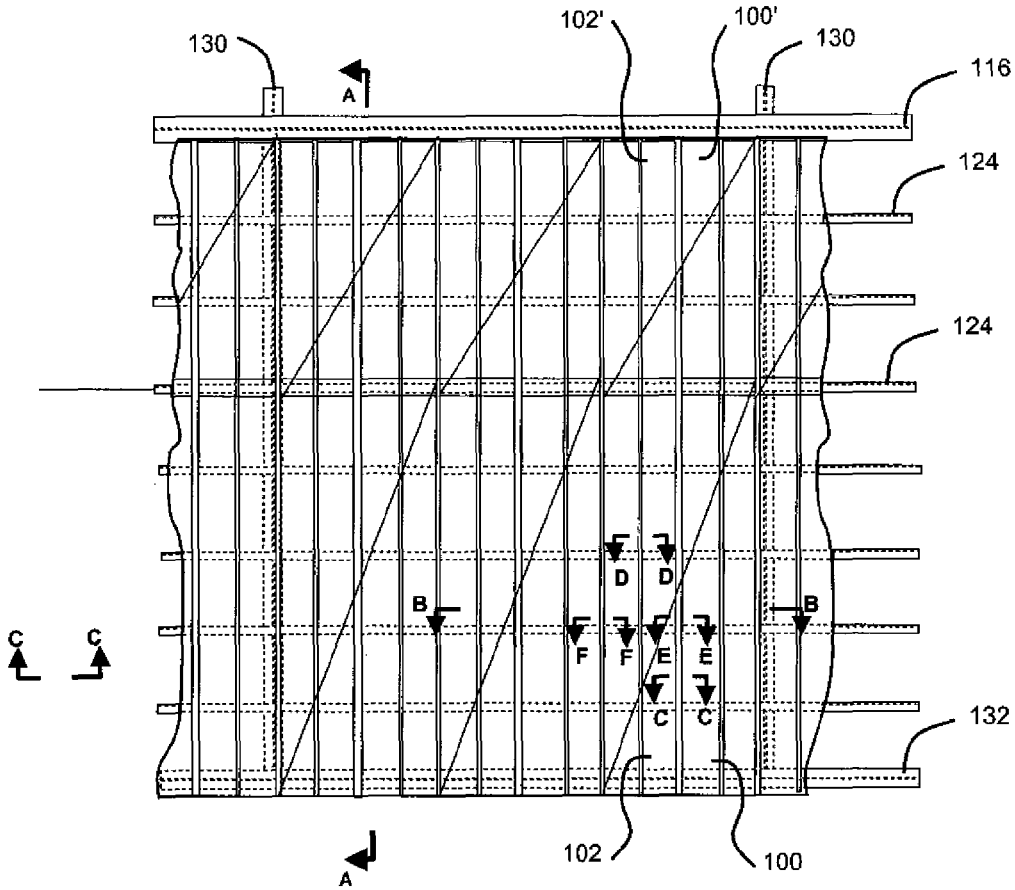
Fig. 12
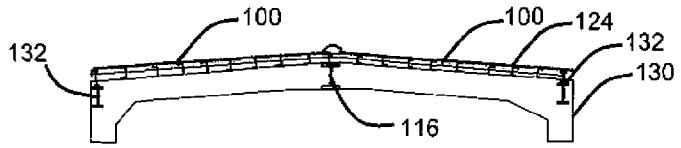
Fig. 13 (section AA)

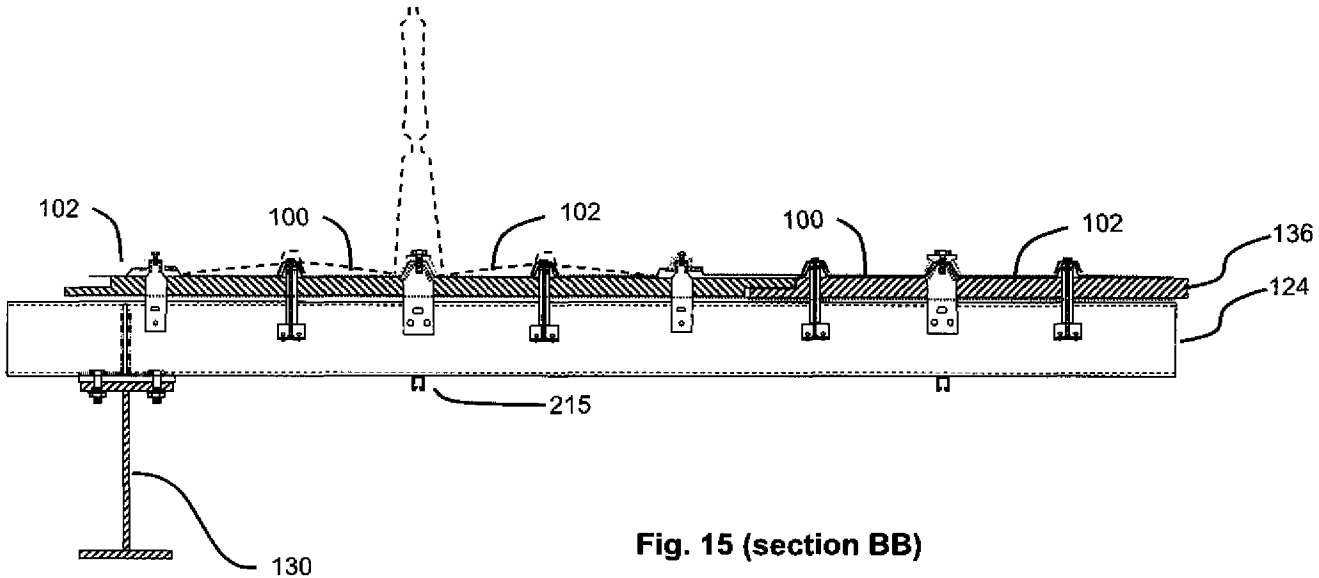
Fig. 15 (section BB)
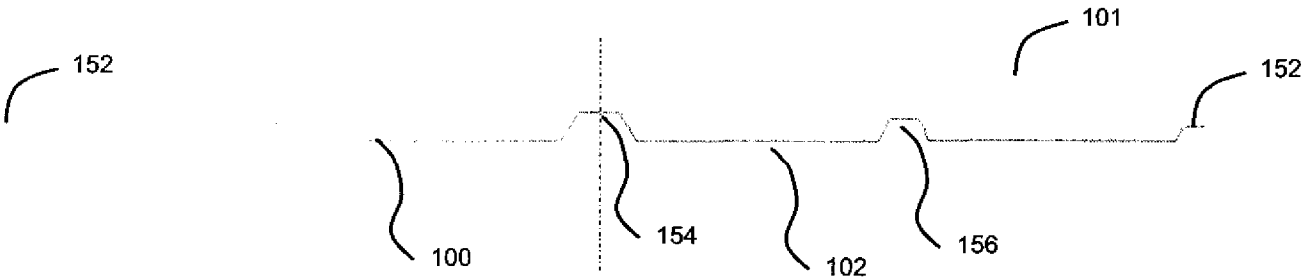
Fig. 14

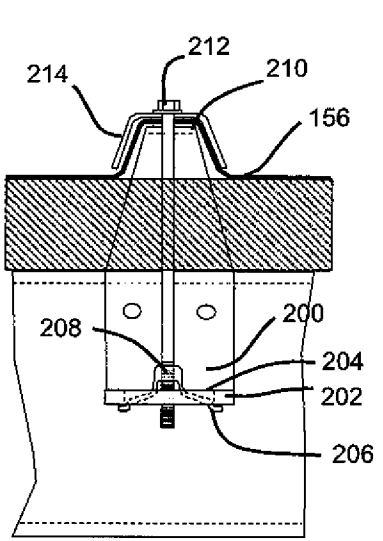
Fig. 19 (section D-D)
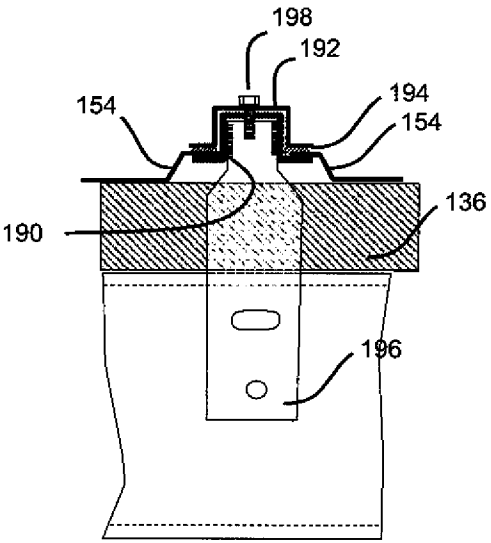
Fig. 18 (section F-F)
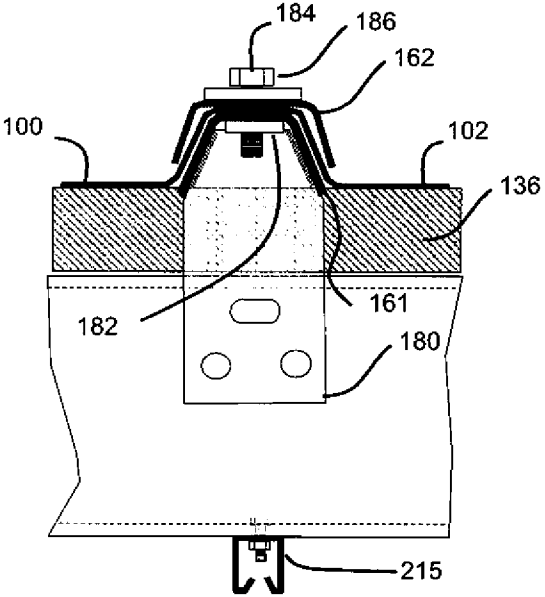
Fig. 17 (section E-E)
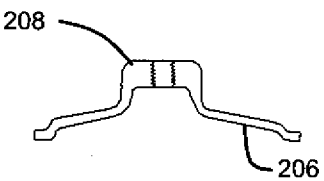
Fig. 20
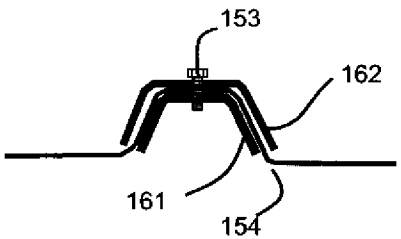
Fig. 16 (section C-C)

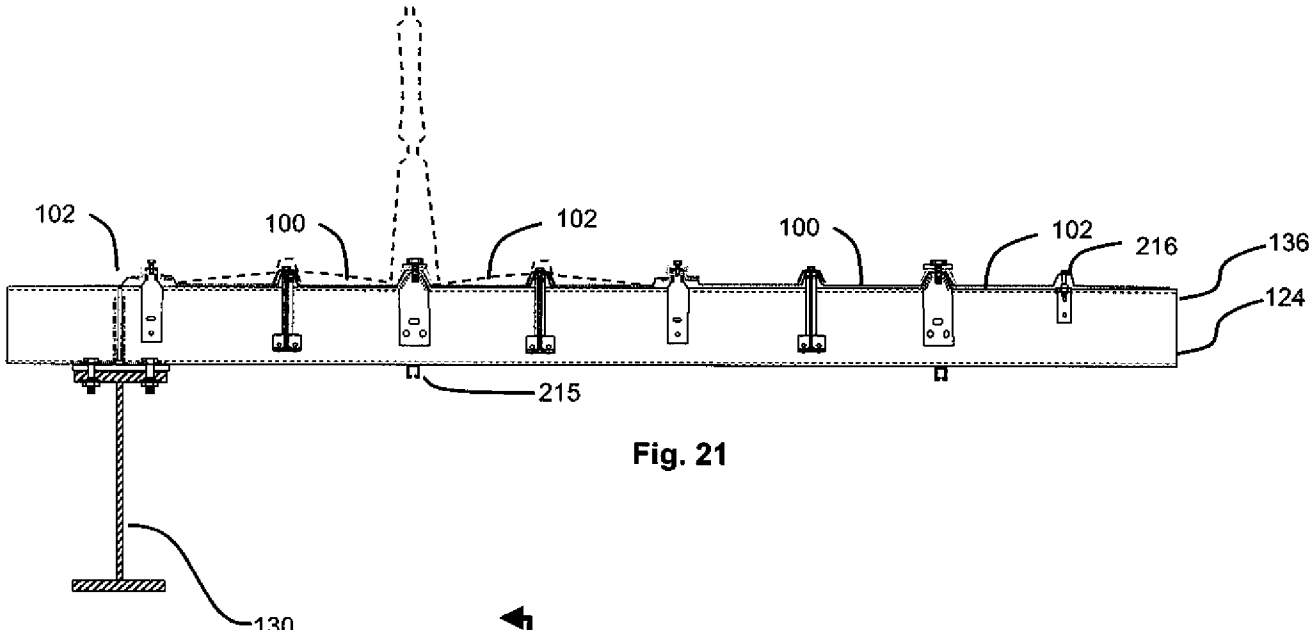
Fig. 21
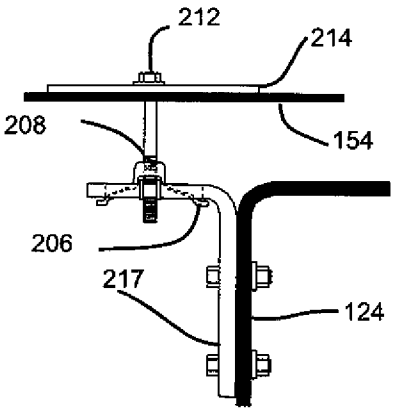
Fig. 23 (section G-G)
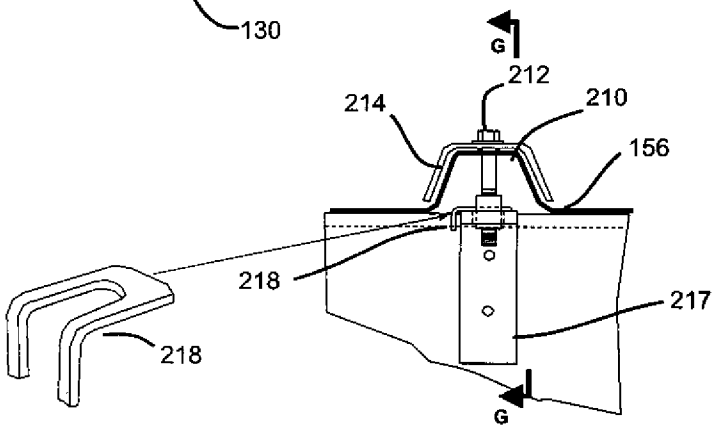
Fig. 22

OVERPRESSURE RELIEF ROOF PANELS

CROSS REFERENCE TO RELATED APPLICATIONS

This application is a national stage application under 35 U.S.C. 371 and claims the benefit of PCT Application No. PCT/EP2011/057807 having an international filing date of 13 May 2011, which designated the United States, which PCT application clamed the benefit of Great Britain Application No. 1008071.1 filed May 14, 2010, the disclosure of both the above-identified applications are incorporated herein by reference.

The present invention relates to overpressure relief roof panels.

It is known to provide enclosures such as rooms or buildings with wall or roof mounted venting arrangements that are designed to open in response to a predetermined overpressure between the inside and the outside of the enclosure such as may be generated suddenly in the event of an explosion within the enclosure.

Such arrangements are commonly used in environments where inflammable or explosive materials are handled, for instance pump rooms in the oil and gas industry.

WO89/11007 describes a pressure relief panel arrangement for use in walls in which a panel member is fixed on a first face along a centre line to a support beam provided as a middle cross-piece in a support frame. Each edge of the panel running parallel to said support beam is trapped in such a way that it can slide free if the panel is outwardly deformed under the influence of an overpressure. Centrally between the edges and the centre line, the panel is retained on its opposite face to each of a pair of further support beams by frangible connections so that in the event of an explosion, the frangible connections give way and on each side of the central support beam the panel bends out, pulling its edges free. Further deformation brings the freed edges together leaving a large aperture open for the escape of explosion gases. However, such an arrangement is not designed to be put in place in a roof and would be unlikely to be sufficiently weatherproof as the panel edges would be at the lowest point and would become submerged in water in the event of rain. The central fixing of the panel would also be at a low level and would not be possible to water proof. Furthermore, the bowed shape of the panels would produce a structure that would be difficult and probably unsafe to walk on. Snow would be difficult to shift from the roof panel and would be likely to interfere with its opening at a desired design pressure.

GB2278376 discloses a pressure relief device for a roof or a wall in which flat steel plates are pivoted at one edge and are able to rise outwardly at their opposite edge to relieve pressure from below. However, the arrangement described would not be practical from a weatherproofing point of view.

The present invention now provides an explosion relief panel suitable for use as a wall or roof panel and comprising, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, the said second raised portion being fixed to a first support member and the said edge portion being mounted to a second support member in a manner such as to be released therefrom in response to an overpressure applied beneath the roof panel to allow the edge of the roof panel to be deflected upwardly to release said overpressure whilst the second portion of the roof panel remains fixed to said first support member. The first and second support members may extend longitudinally beneath the panel.

Optionally, said second raised portion of the panel is also an edge portion. Alternatively it is within the width of the panel and the second edge of the panel may be similar to said first edge so that at the second edge of the panel also there is a raised longitudinally extending portion, with a lower lying drain portion lying between the second edge portion and said second raised portion. The second raised portion may lie symmetrically between the two edges.

Optionally, said edge portion is mounted to the second support member in a manner such as to be released therefrom in response to an overpressure applied beneath the roof panel to allow the edge of the roof panel to be deflected upwardly to release said overpressure by said edge being trapped in an edge facing slot of a fixing to said second support member, such that upward bowing of the panel to shorten the span thereof pulls the edge free from the slot. Where as described above the second raised portion is not at the opposite edge, the second edge of the panel may be similarly secured to be releasable under such overpressure.

Said respective longitudinally extending drain portions may be unitary with one another or alternatively, they may be separated, for instance by a longitudinally running raised corrugation or more than one such corrugation, the corrugations then being separated by lower lying drain portions.

Such a raised corrugation may be fixed to transversely running panel support members by fixings designed to release in response to a sufficient overpressure beneath the panel.

Optionally, said longitudinally running raised corrugation is covered by a reinforcing strip having a top wall covering the top of said corrugation and side walls extending down over side walls of the corrugation and serving to prevent widening of the panel by spreading of the corrugation walls responsive to overpressure below said panel and to provide increased resistance to external loads.

Preferably, those portions of the panels that lie between the raised edges and any such raised corrugation are flat, providing no obstacle to the laying of boards upon which personnel can walk for maintaining the roof.

Preferably, the panels are not under lateral compression which would oppose inward movement of the said edge portion of the panel.

The first support member and the second support member may be longitudinally extending parts of a pre-formed roof support framework, which may include further longitudinally and or transversely running support members. The panel and other similar panels may then be fixed in place as required to provide explosion relief characteristics to the roof.

However, the panels and the required support members may be provided as prefabricated cassettes for installation in a roof and accordingly, in a second aspect, the invention provides an explosion relief cassette suitable for installation in a wall or roof framework, said cassette comprising an explosion relief panel having, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, said cassette further comprising a first longitudinally extending support member to which is fixed the said second raised portion of the panel and a second longitudinally extending support member to which is mounted the said edge portion of the panel in a manner such as to be released from said second support member in response to an overpressure applied beneath the roof panel to allow the edge of the roof panel to be deflected upwardly to release said overpressure whilst the second portion of the roof panel remains fixed to said first support member.

In such a cassette said explosion relief panel may be an explosion relief panel having any of the optional characteristics described above.

In a further aspect, the invention includes a building comprising a roof or a wall which incorporates one or more explosion relief panels or explosion relief cassettes as described herein.

The building may comprise cross-wise running support members over which said explosion relief panel or panels span and to which said panels are held by fixings applied from the outside of said panels. The support members may be purlins which are supported on portal frames.

It will be appreciated that although the panels of the invention are designed primarily for use in roofs, they are also useable in walls.

The invention will be further described and illustrated with reference to the accompanying drawings, in which:

FIG. 12 shows a part of a roof according to a second embodiment in plan view;

FIG. 13 shows a section on the line A-A of the roof of FIG. 12;

FIG. 14 shows the profile of a roof panel used in the roof of FIG. 12;

FIG. 15 shows a section on the line B-B of the roof of FIG. 12;

FIG. 16 shows a section on the line C-C of the roof of FIG. 12;

FIG. 17 shows a section on the line E-E of the roof of FIG. 12;

FIG. 18 shows a section on the line F-F of the roof of FIG. 12;

FIG. 19 shows a section on the line D-D of the roof of FIG. 12;

FIG. 20 shows a part sectioned side view of the clip of the fixing shown in FIG. 19;

FIG. 21 shows a view similar to FIG. 15 of a modified embodiment in which no insulation is provided below the roof panels;

FIG. 22 shows a view similar to FIG. 19 of a modification of the fixing arrangement shown in FIG. 19 for use in the embodiment of FIG. 21; and FIG. 23 shows a section on the line G-G of FIG. 22.

FIRST EMBODIMENT

In an illustrative embodiment, the invention takes the form of a roof panel cassette which can be installed adjacent others of its kind to fill apertures in a framework of roof support members.

Figure 1:
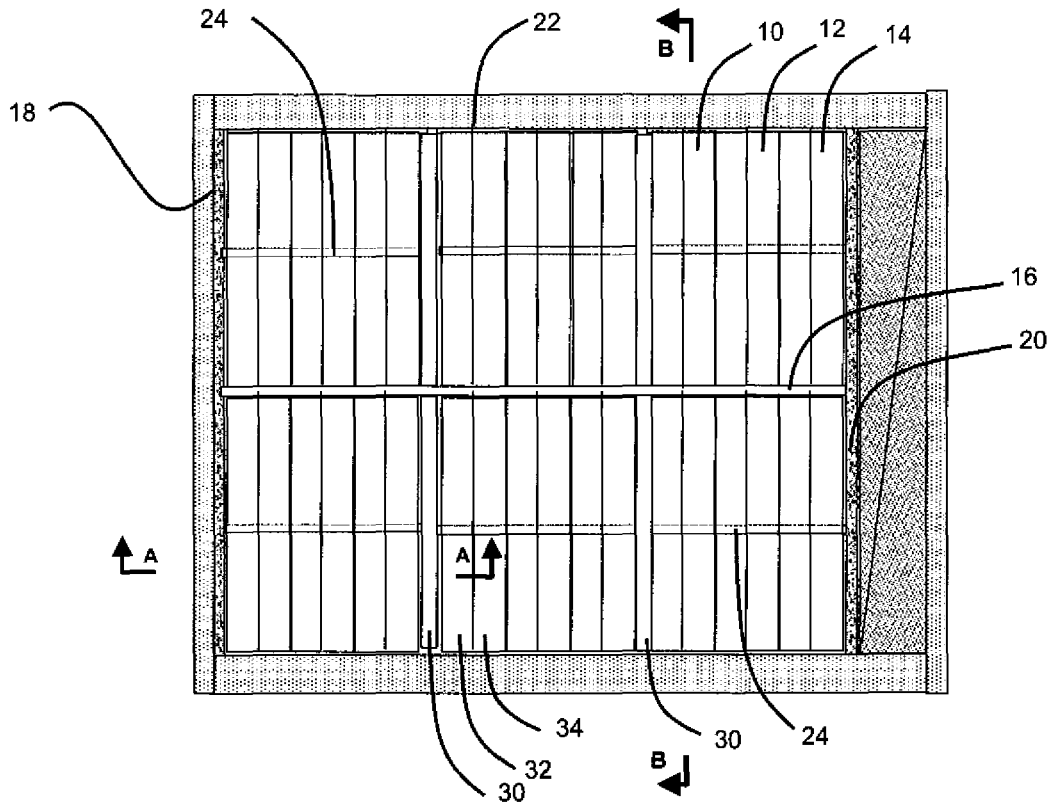
FIG. 1 shows a plan view of a pitched roof incorporating pressure relief panels of the invention.
Figure 3:
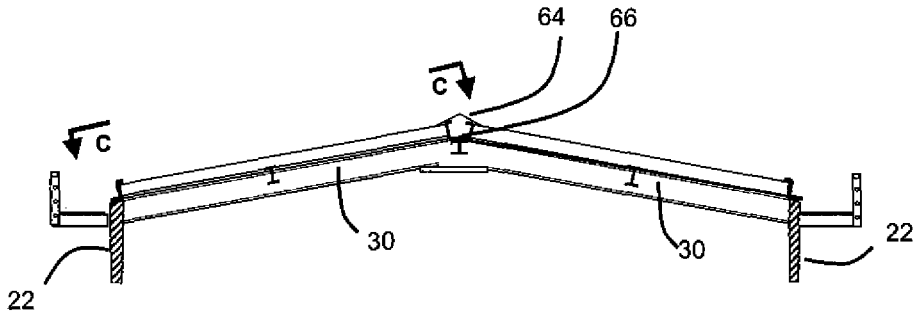
FIG. 3 shows a transverse section on the line B-B of FIG. 1.
Figure 2:
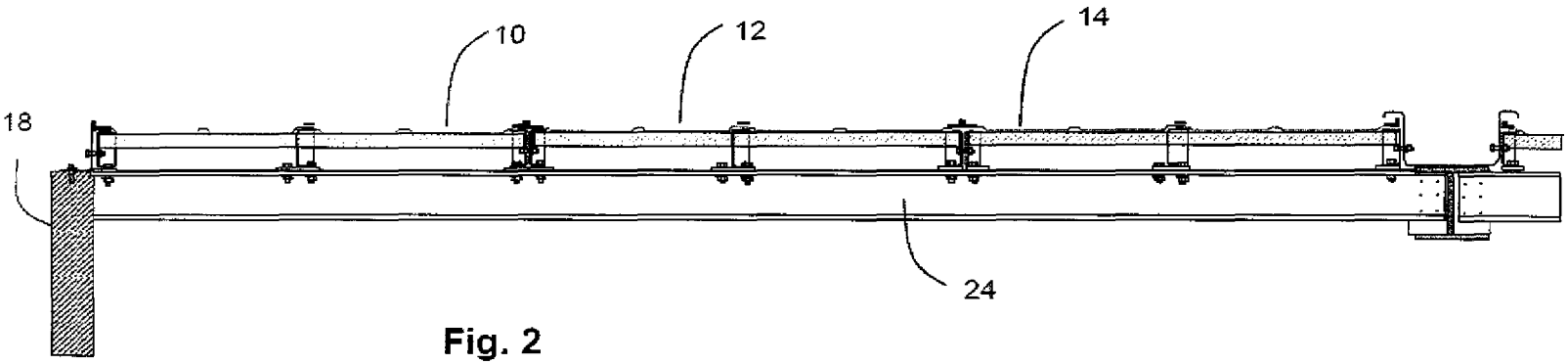
FIG. 2 shows a transverse section on the line A-A of FIG. 1.

Examples of such cassettes suitable for the roof of a building or other type of enclosure are shown in FIGS. 1 to 11A and B. FIG. 1 shows a pitched roof framework covered by six sets of three cassettes 10, 12 and 14, each 1.8 m wide ×8.3 m long (see FIG. 1, 2, 3).

The roof framework includes a ridge beam 16 extending between first and second gable ends 18 and 20, with three sets of three cassettes on each pitched face of the roof. Between each set of three cassettes, roof trusses 30 extend sloping down from the ridge beam 16 to the building side walls 22. There is a row of cassettes on each slope of the roof and the middles of the cassettes are supported on transverse beams 24 running parallel to the ridge beam. Of course, more than one row of cassettes could be provided, suitable arrangements being made to waterproof the zone where upper and lower rows of cassettes meet.

For the building shown in FIG. 1, which has a plan area of 16 m×20 m (320 $m^2$), provision is made for 269 $m^2$ of Explosion Relief Cassettes. The effective vent area is less because the framing of the roof and of the panels remains in place during and after explosion in the building and the panels remain attached but in an open position (see FIG. 5). The effective relief area is approximately 200 $m^2$, i.e. about 75% of the gross roof area.

Figure 4:
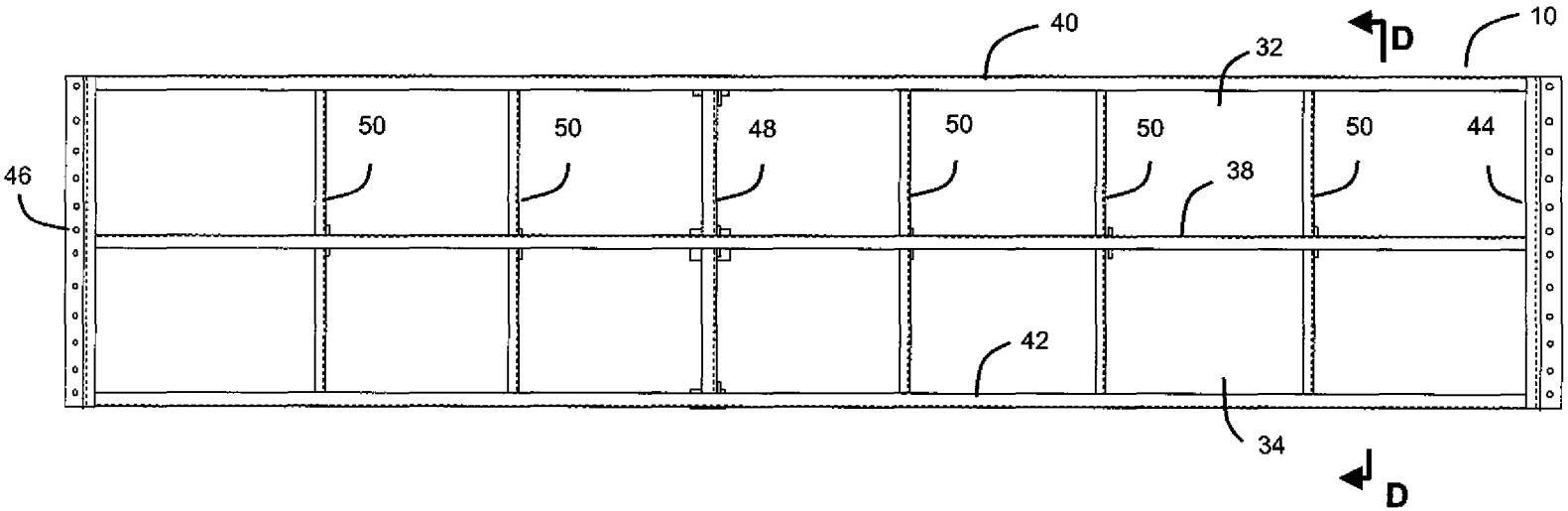
FIG. 4 shows a plan view on the line C-C of FIG. 3, showing the supporting frame with the panels removed for clarity.

A cassette 10 comprises a 1.8 m×8.3 m steel framework (FIG. 4) with two weatherproof stainless steel or aluminium panel leaves 32,34 typically 1.5 mm thick (FIG. 5) covered optionally with high density Rockwool insulation 36 for thermal or fire or sound insulation on the underside. The insulation has been omitted for clarity below the left hand panel 32 in the view shown in FIG. 5, but in practice it would be provided there too. A frame as shown in FIG. 4 comprises a spine beam 38 along at or near the middle of the cassette and two edge beams 40, 42. A special shaped end-profile 44, 46 is provided at each end (44 at the wall end, 46 at the ridge end) to allow the frames to be bolted securely to the frame of the building. For cassettes of this length there is an additional cross beam 48 at or near mid-length which can also be bolted to the frame of the building, to stiffen the cassette when it is installed. There are small transverse beams 50 (preferably L sections), across the cassette at typically one meter centres.

Each frame is a welded or bolted assembly (or part welded/bolted). Frames are designed to withstand wind and snow loads and loads from personnel who might be maintaining the panels. They are also designed for the short-term dynamic forces applied to them just prior to and during panel opening in explosion and, if applicable, explosion pressures applied to the outside as may result from a vented explosion in an adjacent similar building.

Figure 5:
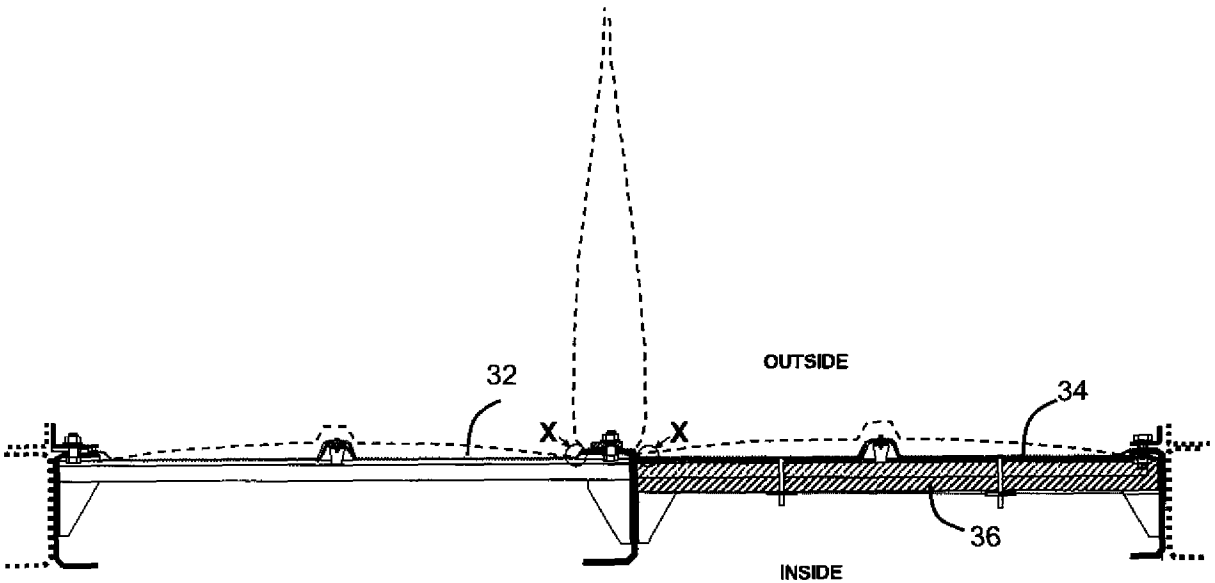
FIG. 5 shows a transverse section on the line D-D of FIG. 4.
Figure 6:
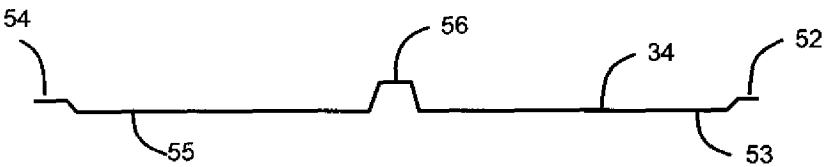
FIG. 6 shows the profile of the corrugated sheet used for the leaf panels of the roof of FIG. 1.

The panels are configured as two lightweight leaves 32, 34 continuous along the length of the cassette (see FIGS. 1, 5 and 6. These leaves are configured to open back-to-back so that panels do not swing past the fully open position and close over the openings of adjacent panels (see FIG. 5). This also reduces the duration of dynamic forces applied to the cassette framework during an internal explosion.

As seen in the profile view of FIG. 6, the panels 32, 34 themselves each comprise a raised longitudinally extending edge portion 52 in the form of an edge flange which is adjacent to and above a longitudinally extending portion 53 which can act as a water drain. On the opposite edge of the panel there is a second raised edge portion in the form of raised edge flange 54. Adjacent edge flange 54 is a longitudinally extending portion 55 that again can act as a water drain. Optionally, the panel as shown could be one half of a double width panel having a second portion which is a mirror image of that shown, integrally connected at their respective edge flanges 54, so that there is a releasable edge flange 52 on each side. Edge flanges 54 of adjacent panels are fixed over one another on the spine beams 38, which each constitute a first longitudinally extending support member. Edge flanges 52 are releasably held at an edge beam 40 or 42 (depending on the handedness of the panel) which each constitute a second longitudinally extending support member.

Figure 9:
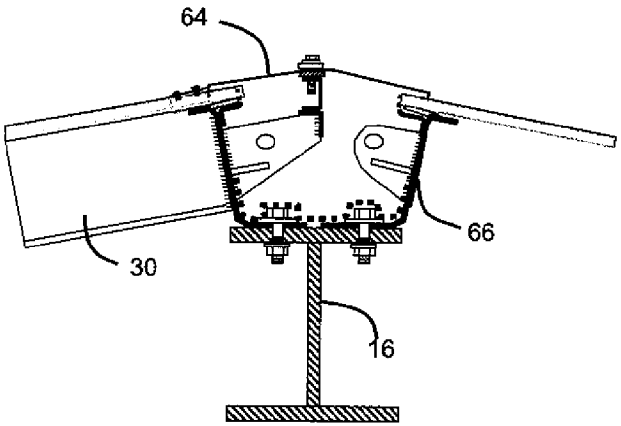
FIG. 9 shows detail of the connections of the panels at the ridge of the roof of FIG. 1.

Installation is simply a question of lifting the cassettes onto the roof beams and fixing them down with bolts at the eaves at the ridge beam and at an intermediate beam 24 parallel to the ridge (see FIG. 9). The cassettes are bolted to each other along their long edges and sealed at the top.

It should be borne in mind that although particularly suitable for use as roof panels, the proposed cassette concept can also be applied for use as vertical or near vertical cassettes in walls in a building or other enclosure (historically the most common site for explosion relief provision). Furthermore the form of construction could be modified so that the cassette frame is replaced by a purpose-designed building frame erected in situ with the relief panels or leaves delivered to and installed in the part-completed building.

Figure 7:
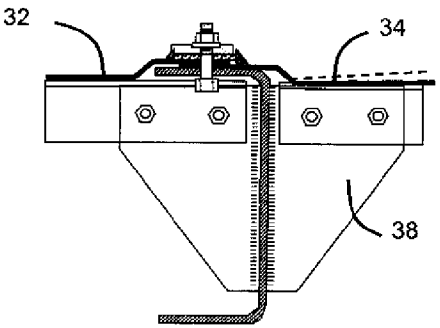
FIG. 7 shows detail of the fixing of the retained edges of the panels in the roof of FIG. 1.
Figure 11B:
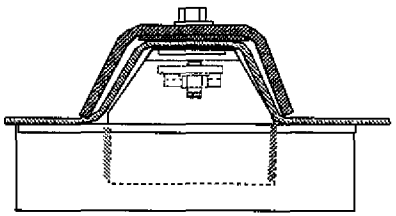
FIGS. 11A and 11B are similar detailed views of a second form of relief clip.

The illustrated panel is stiffened longitudinally by a corrugation 56 near the middle (see FIG. 6) to reduce out of plane flexibility for wind loading and improve fire-resistance (reduction of distortion in fire) should fire resistance be required. The panel 32 or 34 is clamped and bolted all along edge 54 as shown in FIG. 7 (which is a section through the spine beam 38 of the cassette). Alternatively the panel can be double the illustrated width with mirror image left and right halves being integrally joined at their edges 54.

Figure 8B:
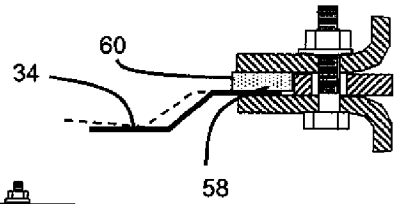
FIGS. 8A and 8B shows detail of the releasable fixing of the other edges of the panels in the roof of FIG. 1.
Figure 8A:
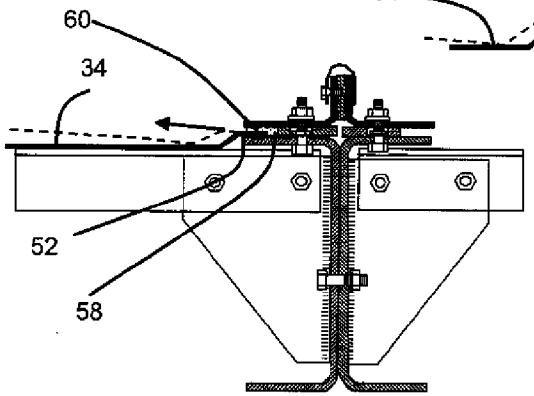

The outer edge 52 is retained in a slot 58 (FIGS. 8A and B, which has a sealing strip 60 in it to prevent water ingress to the insulation below (if present) or leakage of gas outwards.

In order to limit deflection of the leaves due to wind forces applied to the panel (in normal operation) the longitudinal corrugation 56 is clipped to each cross member 48, 50 and to a flange on the end profile 43 or 44. FIGS. 10A and 10B and FIGS. 11A and 11B show two alternative clip configurations. In the example shown in FIG. 4 there are 2×8 clips for one cassette—at about 1.1 m intervals in this example.

The clips are sized to hold the panel securely and permanently against the frame in normal operating situations (e.g. storm wind loads) but to deform at a suitably low load during an internal explosion so as to be released from their attachment to the transverse members of the frame. During an explosion within the building, controlled release pressure (e.g. 30 to 50 hPa) is assured by bending of the internal fixing clips (see FIGS. 10A and 11A until they become released from each cross member.

Figure 10B:
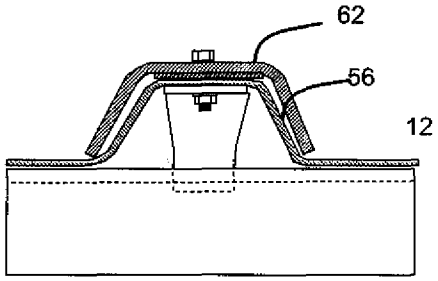
FIGS. 10A and 10B are respectively detailed views of a first form of relief clip viewed from the side (FIG. 10A) and on the line X-X through the corrugation of the roof panel (FIG. 10B)
Figure 10A:
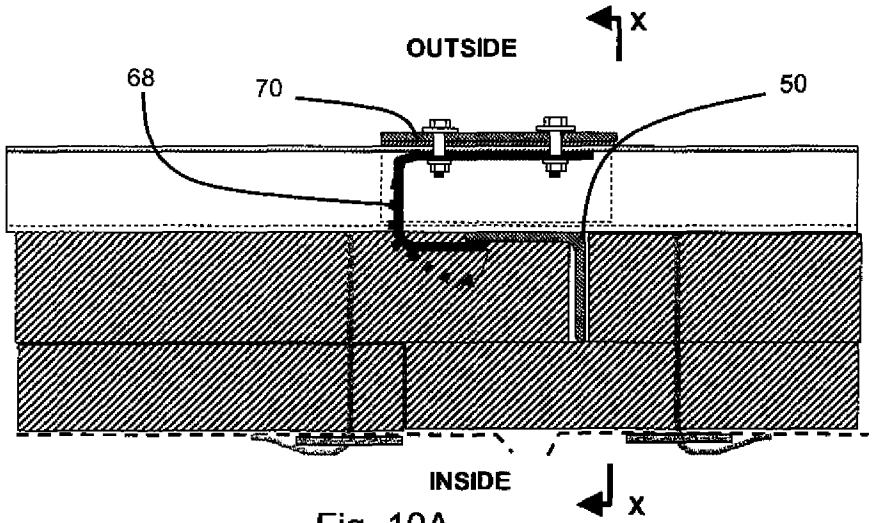
Figure 11A:
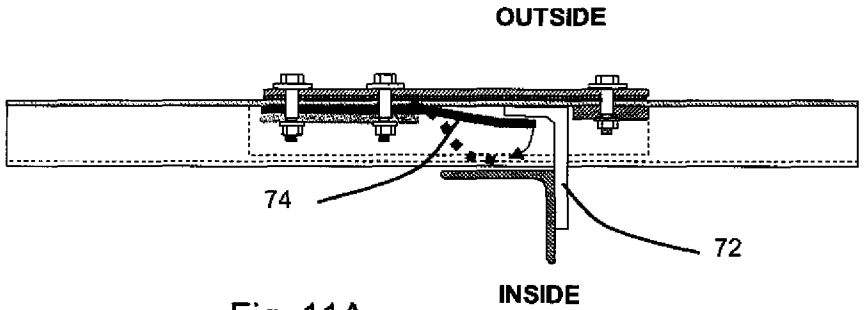

Each FIGS. 10A and B or FIGS. 11A and B clip is made of deformable material such as stainless steel and is bolted or otherwise fixed to the inside of the longitudinal corrugation of the leaf. FIGS. 10A and 11A show two alternative clip configurations and FIGS. 10B and 11B each show a section on the line X-X through the corrugation at the clip. Clips are sized and bench-tested so that their bending resistance is known at both slow load application and at high rates of load application as would occur due to explosion.

A first design for a clip fitted under the corrugation 56 and designed to release under explosion pressure is shown in FIGS. 10A and B. The longer arm of the J section clip 68 is bolted to the underside of the corrugation 56 by bolts passing through the trapezoidal profile 62 and an elastomeric or fibre gasket 70. The shorter arm of the clip 68 is caught under an L-shaped beam 50 and is bent to the dotted position shown in the event of an explosion, so releasing the panel from the beam.

In the alternative arrangement seen in FIGS. 11A and B, an L shaped bracket 72 is bolted to the beam 50 and the J shaped clip 68 is replaced by bent clip 74 which catches beneath the bracket 72 and deforms further downwardly under explosion over pressure within the building.

Each leaf of the relief panel itself has a certain bending stiffness and the deformation of the clip (several mm at the moment of release) increases the resistance of the leaf to internal pressure at this time so that this resistance is added to that provided by the clip. After release from the clip the leaf bows and bulges out with resistance to internal pressure building due to transverse bending stiffness of the leaf. At some level of deflection the span shortening of the panel (due to its transverse curvature) reaches a level such that the outer edge 52 of the panel slips out of the retaining slot 58 (FIG. 8*b*) where the seal is located. From this moment onwards the resisting pressure drops to near zero as the panel leaf 32 or 34 hinges about its line of fixing to the spine beam (see marked X in FIG. 5). A yield line forms in the leaves each side of the spine beam and the resistance to opening of the panel is then only a function of the bending resistance of this yield line.

The swing motion of the leaf stops abruptly when the one leaf meets the other leaf in the fully open position (see FIG. 5). From this time onwards the restriction of outflow of explosion products from the building is a restriction of flow area past the framing of the cassette: free area is about 75% of gross cassette area. Tests have shown that some of the insulation is blown out, but as this is light and soft it soon decelerates and would not cause serious harm to persons and facilities in the far-field.

Under explosion loading from inside there are three peaks of pressure resistance: the first when the clip releases, the second when the leaf is released from the retaining slot along its outer edges, and the third when the panel bends about its hinging line. The effective release pressure for the vent panel is the highest of these three resistances and is a key parameter when calculating the effectiveness of the venting process. The mass of the panel and the leaf width are also critical parameters to venting efficiency.

During the bulging phase of the leaf it is important that the corrugations do not flatten out due to excessive sliding resistance at the outer edge slots where the seals are. This would widen the panel leaf, meaning that more bulging deflection would be required to release the panel from the edge slots and could increase the release pressure at this phase of panel opening. To combat this a pressed trapezoidal profile 62 (FIGS. 10B, 11B) is provided—to prevent the corrugated panel being stretched in width. This profile has the additional advantage of improving vertical load capacity at this point—which ensures improved external explosion pressure resistance and reduced risk of local deformation during maintenance activities on the roof.

Weathertightness is assured by making all attachments through the leaves and edge connections at the top of corrugations to allow free drainage of rainwater down the panels. This will be a reliable method of preventing leakage providing the panels are kept clean. The long edges of the panels are fitted with elastomeric and/or mastic seals.

The bottom short edge is a free edge from which water can drop into a gutter and seals pressed up against the underside of the profiled leaf would prevent wind-blown rain from coming up under the eaves. This supplementary seal can be changed in service without affecting venting performance during maintenance.

Similarly at the ridge of the roof a shaped and pressed metal capping profile is used and for wind driven rain that passes the lower edge of this the seal beneath the panel provides an additional weathertightness and water that passes the ridge profile can be collected in a space 66 below the capping profile 64 and drained away. The capping profile is weak and flexible enough not to affect panel relief pressure significantly.

Snow Load

The cassettes would be designed for snow loads (where applicable) and consideration would have to be given to the mass and frequency of snow loading on the panels in respect of its impact on venting efficiency. To combat this trace heating could be provided beneath the panel leaf at the top of the insulation. It may not be necessary to melt all the snow on the panel as it is quite possible that such heating could lead to the snow melting at its underside, with the upper layers of snow insulating the lower layers from the cold, with the result that the whole snow layer could slide off the surface of the roof.

Resistance to External Explosion.

Occasionally there is a requirement to design explosion relief panels for resistance to external explosion. By placing the relief panels on the roof (rather than the walls) of a building explosion impulses arriving from other nearby buildings or areas in which an explosion can occur will not be reflected due to too low an angle of incidence relative to the surface of the relief cassette for the arriving blast wave. Compared to vertical panels this will typically halve the peak dynamic pressure applied to the cassette in a given explosion scenario (reflection factor typically 2 to 2.5). It would also avoid the pressure augment that a Mach Stem might otherwise cause when angles of incidence are around 45 deg relative to the panel.

If one building is protected by roof-mounted relief panels then the incident over-pressures caused on adjacent buildings will normally be less because the explosion is not being vented in a direction towards adjacent buildings but upwards instead: this could lead to a further reduction in building to building blast effects.

Backing up the explosion relief panels by strong internal framing can ensure that the first positive phase of the explosion impulse is resisted and this may be sufficient even if the panel bounces open on the rebound when the roof structure is set into dynamic motion by the applied shock. If the vent pressure set for the panels is less than the rebound load the panels will open.

Resistance to Poison Gas from Other Buildings or External Fires, Following an Explosion in an Adjacent Building In some circumstances avoidance of rebound opening in response to high external explosion overpressures can be a requirement, for instance if there is a risk of leakage of poison gas consequent upon explosion in a nearby similar building or plot where hazardous materials are being processed.

Second Embodiment

This embodiment lends itself to easy installation on a building which has been constructed to the extent that a roof area has already been defined by structural members that have been assembled in place to which it is desired to fix roof panels having explosion pressure relief character. The roof structural members may comprise a member extending longitudinally at a highest edge of a roof face, for instance at a ridge of a gable ended roof (e.g. a ridge girder) and a member extending longitudinally at the lowest edge of the roof face (e.g. an eaves girder), and may also comprise purlins running parallel to said longitudinal members. All of these may be supported on portal end frames and optionally intermediate portal frames also.

The roof shown in FIG. 12 comprises a ridge girder 116 and purlins 124 running parallel thereto supported on portal frames 130 which support also eaves girders 132. These components will have been pre-assembled on site before the roof components are fitted.

Roof panels 101 made up of mirror image right and left hand halves 100 and 102 are arranged side by side and joined by longitudinal edges as described below. The panels are supported at a lower end by the eaves girder 132 and at an upper end by a purlin 124. A shorter second panel made up of halves 100' and 102' extends from that purlin 124 up to the roof girder 116 and form a lap joint with panel 101 (100 and 102) as further described below.

The profile of the panel 101 and of the shorter version thereof is seen in FIG. 14. There is a central plane of symmetry dividing halves 100 and 102 or 100' and 102'. Each profile has a first raised longitudinally extending edge flange 152 and a second, opposite edge flange 152. Between the edge flanges is a central raised corrugation 154 forming a second raised longitudinally extending portion. Additionally, between the central corrugation 154 and the edge flanges 152 there is at least one raised corrugation 156. The width of the panel may suitably be about 1400 mm.

The central corrugation 154 is supported underneath by a trapezoidal profile member or cap member 161 and is reinforced from above by a second trapezoidal profile member 162. The flanges and trapezoidal profiles are secured by self-drilling, self-tapping screws 153.

As seen in FIG. 15, the panels 101 are mounted to purlins 124 over insulation panels 136. To secure the panels 101 to the purlins, the lower profile 161 carries at intervals along its length a welded on depending support plate 180, pre-drilled with fixing apertures, and an adjacent welded nut 182. The support plate 180 is bolted to the purlin. The holes in the support plate may be shaped to allow some sideways adjustment. At these locations the upper profile 162 is held by a bolt 184 passing through a cap plate 186 into the nut 182. Thus, the lower profile 161 may first be fitted to the purlins 124, followed by the laying down of the panels 101 and then the securing of the panels by fitting the upper profile 162.

FIG. 18 shows the arrangement at the panel free edges at flanges 152. Each free edge is supported on an edge flange of a lower top hat profile 190 and is trapped between that and the underneath of an edge flange of an upper top hat profile 192 with a sealing strip 194, suitably of sponge, also being trapped there. Here also a support plate 196 is provided welded in and depending from the lower profile 190 and having holes for bolting it to the purlin 124. The upper top hat profile is held down by SDST screws 198.

In assembling the roof, the lower top hat profiles are fixed to the purlins and the panels and the upper top hat profiles can then be fixed to them.

Generally, the profiles 161, 162, 190, and 192 could be replaced by short lengths rather than running essentially the length of the panel, although this is not preferred for the profile 162.

To cooperate with each corrugation 156, brackets 200 are bolted to purlins 124 using fixing holes in the plate. Bracket 200 carries a transversely extending flange 202 at its lower end having a rectangular slot 204 in which is received a middle part of a hanger shaped ductile steel, spring steel, plastics, or aluminium clip 206 having an internally threaded central boss 208. Clip 206 is just too long to pass through the slot without bending. At its upper end, the bracket has a transversely extending top plate 210 which fits within the corrugation 156. A long bolt 212 passes through an aperture in a trapezoidal section cap 214, then through an aperture in the top of the corrugation 156 to engage in the boss 208 of the clip 206.

In assembly, the cap 214 and the bolt 212 can be fitted once the panels are in place, and the length of the fixing bolt makes it easy to adjust for any misalignment between the fixing hole in the profile 156 and the bracket 200.

The plate 210 provides support for the roof panel against external pressure, arising for instance from an external explosion and against mild negative pressure which might result from wind action.

In the event of an explosion below the roof, the edges 152 of the panels pull out from the spaces between the upper and lower top hat profiles as the bending of the panels upwards shortens their span, so that the panels move to the position shown dotted in FIG. 15. The ductile clip 206 deforms to allow the release of the corrugation 156 as the panel deflects.

Third Embodiment

As shown in FIG. 21, the insulation 136 shown in FIG. 15 can be omitted and the construction of the roof can be adapted to suit. This may be preferred where the roof is fitted to a building in a sufficiently hot climate. In such a building, the side walls may be left open or permanently ventilated but there may still be a requirement of relief of explosion pressure via the roof area.

In FIGS. 22 and 23 there is shown a suitable modification of the fixing shown in FIG. 19 for restraining the corrugation 156 of the roof panel. Bracket 200 is replaced by a bracket 217 bolted to purlin 124. A horizontally extending flange of bracket 217 contains a hole or slot receiving the clip 206. For temporarily retaining of the clip in the hole or slot, the top of the clip is gripped in a retainer 218 which is slid on top of the flange and has an open ended slot formed between arms receiving the central boss 208 of the clip 206 in an interference fit. Alternatively, the retainer 218 has bend down tabs formed by the ends of the arms for holding it in position. This enables the clips 206 to be pre-mounted on the brackets 207 such that the roof panels can be fitted from above without the necessity of assistance from below the roof panels.

Item 215 is a transverse member which links and stabilises the bottom flange of the purlins against lateral buckling when the panels are open and the explosion gas products are blowing out from below causing forces on the purlins and open panels. These also provide support for light fittings etc.

In this specification, unless expressly otherwise indicated, the word 'or' is used in the sense of an operator that returns a true value when either or both of the stated conditions is met, as opposed to the operator 'exclusive or' which requires that only one of the conditions is met. The word 'comprising' is used in the sense of 'including' rather than in to mean 'consisting of'. All prior teachings acknowledged above are hereby incorporated by reference. No acknowledgement of any prior published document herein should be taken to be an admission or representation that the teaching thereof was common general knowledge in Australia or elsewhere at the date hereof.

The invention claimed is:

1. An explosion relief panel assembly comprising an explosion relief panel suitable for use as a wall or roof panel mounted to generally parallel spaced first and second elongate support members forming part of a wall or part of a roof, said explosion relief panel comprising, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, the said second raised portion being fixed to said first support member and the said edge portion being mounted to said second support member in a manner such as to be released therefrom in response to an overpressure applied beneath the panel to allow the edge of the panel to be deflected upwardly to release said overpressure whilst the second portion of the panel remains fixed to said first support member.

2. The panel assembly of claim 1, wherein said second raised portion of the panel is also an edge portion.

3. The panel assembly of claim 1, wherein said respective longitudinally extending drain portions are unitary with one another.

4. The panel assembly of claim 1, forming part of a roof so that said panel is mounted as a roof panel, wherein said panel edge portion is mounted to the second support member in a manner such as to be released therefrom in response to an overpressure applied beneath the roof panel to allow the edge of the roof panel to be deflected upwardly to release said overpressure by said edge being trapped in an edge facing slot of a fixing to said second support member, such that upward bowing of the panel to shorten the span thereof pulls the edge free from the slot.

5. The panel assembly of claim 1, wherein said respective longitudinally extending drain portions are separated by a longitudinally running raised corrugation.

6. The panel assembly of claim 5, wherein said raised corrugation is fixed to transversely running panel support members by fixings designed to release in response to a sufficient overpressure beneath the panel.

7. The panel assembly of claim 5, wherein said longitudinally running raised corrugation is covered by a reinforcing strip having a top wall covering the top of said corrugation and side walls extending down over side walls of the corrugation and serving to prevent widening of the panel by spreading of the corrugation walls responsive to centrifugal force consequent on panel movement in response to overpressure below said panel and to provide increased resistance to external loads.

8. The panel assembly of claim 7, wherein said fixings comprise a deformable clip positioned below an aperture in a roof support member, said clip being connected to said roof panel, such that in response to a said overpressure, the clip is forced through the aperture to release the panel.

9. An explosion relief cassette suitable for installation in a wall or roof framework, said cassette comprising an explosion relief panel having, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, said cassette further comprising a first support member to which is fixed the said second raised portion of the panel and a second support member to which is mounted the said edge portion of the panel in a manner such as to be released from said second support member in response to an overpressure applied beneath the roof panel to allow the edge of the roof panel to be deflected upwardly to release said overpressure whilst the second portion of the roof panel remains fixed to said first support member.

10. The cassette of claim 9, wherein said second raised portion of the panel is also an edge portion.

11. A building comprising a roof or a wall which incorporates one or more explosion relief panels comprising, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, the said second raised portion being fixed to a first support member and the said edge portion being mounted to a second support member in a manner such as to be released therefrom in response to an overpressure applied beneath the roof panel to allow the edge of the roof panel to be deflected upwardly to release said overpressure whilst the second portion of the roof panel remains fixed to said first support member.

12. The building of claim 11, comprising cross-wise running support members over which said explosion relief panel or panels span and to which said panels are held by fixings applied from the outside of said panels.

13. The building of claim 12, wherein said support members are purlins which are supported on portal frames.

14. A building comprising a roof or a wall which incorporates one or more explosion relief cassettes comprising an explosion relief panel having, when oriented as a roof panel, a raised longitudinally extending edge portion which is raised above a respective adjacent longitudinally extending drain portion of the panel and which has a second raised longitudinally extending portion which is raised above a respective adjacent longitudinally extending drain portion lying between said second raised portion and said edge portion, said cassette further comprising a first support member to which is fixed the said second raised portion of the panel and a second support member to which is mounted the said edge portion of the panel in a manner such as to be released from said second support member in response to an overpressure applied beneath the roof panel to allow the edge of the roof panel to be deflected upwardly to release said overpressure whilst the second portion of the roof panel remains fixed to said first support member.

15. The cassette of claim 9, wherein said respective longitudinally extending drain portions are unitary with one another.

16. The cassette of claim 9, wherein said respective longitudinally extending drain portions are separated by a longitudinally running raised corrugation.

17. The cassette of claim 16, wherein said raised corrugation is fixed to transversely running panel support members by fixings designed to release in response to a sufficient overpressure beneath the panel.

18. The cassette of claim 16, wherein said longitudinally running raised corrugation is covered by a reinforcing strip having a top wall covering the top of said corrugation and side walls extending down over side walls of the corrugation and serving to prevent widening of the panel by spreading of the corrugation walls responsive to centrifugal force consequent on panel movement in response to overpressure below said panel and to provide increased resistance to external loads.

19. The cassette of claim 18, wherein said fixings comprise a deformable clip positioned below an aperture in a roof support member, said clip being connected to said roof panel, such that in response to a said overpressure, the clip is forced through the aperture to release the panel.

* * * * *